US005932025A

United States Patent [19]

Sylvain

[11] Patent Number: 5,932,025

[45] Date of Patent: Aug. 3, 1999

[54] RETRO-FITTING PROCESS OF A BAND PRODUCT TREATMENT UNIT AND UNIT THUS RETROFITTED

[75] Inventor: Daniel Sylvain, Verneuil-Sur-Seine, France

[73] Assignee: Kvaerner Metals Clecim, Paris, France

[21] Appl. No.: 08/914,792

[22] Filed: Aug. 20, 1997

[30] Foreign Application Priority Data

Aug. 22, 1996 [FR] France ..... 96 10376

[51] Int. Cl.[6] ..... C23G 1/02

[52] U.S. Cl. ..... 134/3; 134/41; 134/15; 29/401.1

[58] Field of Search ..... 134/2, 3, 15, 26, 134/32, 34, 41, 122 R, 64 R, 9; 29/401.1, 402.1, 402.8

[56] References Cited

U.S. PATENT DOCUMENTS

| | | | |
|---|---|---|---|
| 3,445,284 | 5/1969 | Robinson et al. . | |
| 3,583,411 | 6/1971 | Stricker | 134/57 |
| 3,871,982 | 3/1975 | Idstein | 134/64 R |
| 4,951,964 | 8/1990 | Hone et al. | 134/9 X |
| 5,246,024 | 9/1993 | Uchino | 134/64 R |
| 5,333,628 | 8/1994 | Ogata et al. | 134/64 R |

FOREIGN PATENT DOCUMENTS

| | | |
|---|---|---|
| 0 032 530 A1 | 7/1981 | European Pat. Off. . |
| 3149902 A1 | 6/1983 | Germany . |

OTHER PUBLICATIONS

Webster's II Dictionary, The Riverside Publishing Company, p. 1041, 1994.

*Primary Examiner*—Jill Warden
*Assistant Examiner*—Alexander Markoff
*Attorney, Agent, or Firm*—Nikaido, Marmelstein, Murray & Oram LLP

[57] ABSTRACT

The purpose of the invention is a treatment unit for a band product (2) comprising at least one extant treatment tub (1) connected to a mechanism (B) for controlling the running of the band product (2) inside the extant tub (1). The at least one extant treatment tub (1) is connected to at least one replacement tub (4) made of an oblong enclosure provided above the extant tub (1) and exhibiting a height (h) lower than the height (H) of the extant tub (1). The replacement tub (4) is associated with an apparatus for injecting the liquid and to the mechanism (B,B') for controlling the running of the band, so that the product (2) runs inside the replacement tub (4) in contact with the treatment liquid (A).

6 Claims, 2 Drawing Sheets

RETRO-FITTING PROCESS OF A BAND PRODUCT TREATMENT UNIT AND UNIT THUS RETROFITTED

BACKGROUND OF THE INVENTION

The invention relates to a retrofitting process of a band product treatment unit, in particular an acid pickling unit for metallic bands.

The unit also covers a unit obtained by the implementation of the process.

In units dedicated to the production of a laminated metallic band, for example of sheet or tinplate, it is customary to let the product pass through a pickling line comprising, normally, a series of pickling tubs filled with an acid solution, for instance hydrochlonic acid, and in which the metallic band is caused to run continuously, wherein the band unwinds from a reel, passing successively through each of the tubs and, after rinsing, is rewound at the output of the unit.

Such units are well-known and do not call for any detailed descriptions.

In older units, it is customary to use relatively deep tubs, located one after the other, inside which the band forms a loop plunging inside the liquid between two band passage thresholds placed above the level of liquid at both ends, respectively upstream and downstream of each tub.

Since the solution becomes loaded with oxides and impurities as the treatment progresses, the solution must be regenerated in order to maintain the desirable acid concentration. Usually, the concentrated solution is injected into the last tub and it overflows, quite simply, into the previous tub and so on and so forth, so that the band passes in succession through tubs whose concentration increases from upstream to downstream.

For some years, technology has evolved and, at the moment, we prefer to use flat or semi-flat tubs, which contain a smaller quantity of liquid and enable quick drainage should the line stop.

In this case, each tub is associated with a cistern or recirculation vessel located beside the line and which enables emptying the tub quickly and which makes maintaining the bath at the requested temperature and concentration easier.

Many pickling lines still in operation and built, in particular, before the Eighties, are fitted with deep tubs and it is interesting, to enhance the performances of the pickling line, to change the existing tubs with new type tubs, flat or semi-flat ones. Such an operation requires, however, prolonged shutdown of the line.

Moreover, the new pickling tubs, which contain a reduced quantity of liquid, must be associated with recirculation vessels, which, most often, do not exist in the former lines. Still, it is advisable not to bring too far-reaching retrofitting procedures to the whole plant and it is often difficult to find sufficient room in the vicinity of the line, to accommodate such a vessel.

OBJECTS AND SUMMARY OF THE INVENTION

The invention remedies these shortcomings thanks to a new retrofitting process for a treatment line, enabling to replace easily and quickly the existing deep tubs with flat tubs with a view to reducing the acid consumption and, besides, to improve the control of the acid and iron concentrations.

The invention exhibits the essential advantage of ensuring retrofitting of the unit without any significant modifications of the extant configurations and for limited costs, whereby the invention enables saving on material and reducing drastically the time necessary to the retrofitting.

According to the invention, the extant unit comprising at least one treatment tub with a first height H associated with band running control means according to a longitudinal direction, at least one replacement tub is provided, made of an oblong enclosure with a second height h lower than the first height H of the extant treatment tub, the replacement tub is placed above the extant tub while associating it with liquid injection means and with the band running control means, whereas the said band thus passes inside the replacement tub in contact with the liquid.

According to another essential characteristic of the invention, the lower section of the extant tub, placed beneath the replacement tub, constitutes a recirculation tub for at least a portion of the treatment liquid contained in the replacement tub.

Preferably, the replacement tub rests on the upper section of the extant tub and can, besides, be engaged at least palatially, into a scalloping arranged at least on a portion of the thickness of the wall of the extant tub, at the upper section of the latter.

According to another particularly advantageous characteristic, the replacement tub is fitted with liquid inlet and outlet tubes connected, respectively, by a recirculation system, to corresponding outlet and inlet tubes provided on the extant tub and enabling recirculation of at least a position of the treatment liquid of one of the tubs towards the other.

BRIEF DESCRIPTION OF THE DRAWINGS

But the invention will be better understood with the following description of a peculiar embodiment given for exemplification purposes, in conjunction with the appended drawings.

DETAILED DESCRIPTION OF PREFERRED EMBODIMENT

Figure 1:
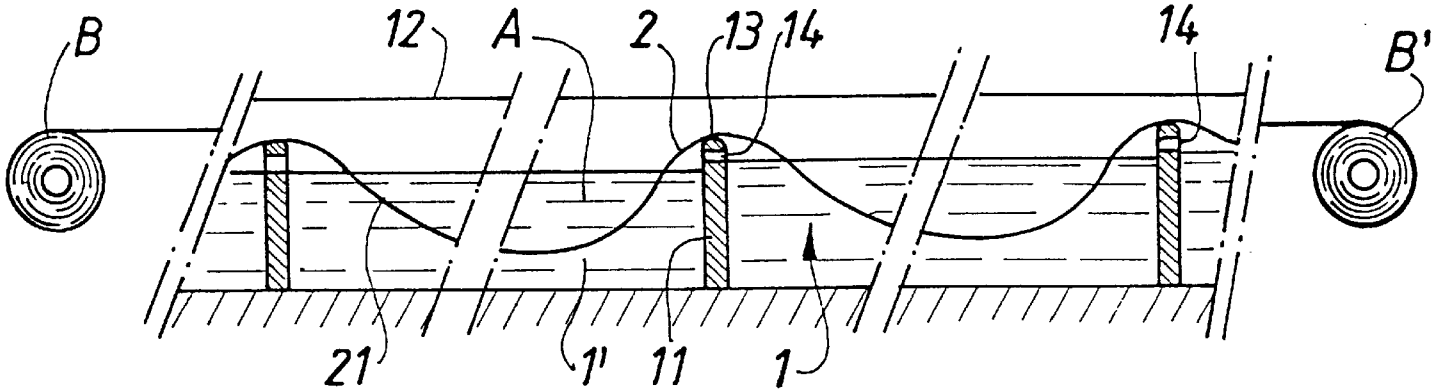
FIG. 1 is a diagrammatic representation of an example of an extant pickling line, of a latter type.

On FIG. 1, we have represented diagrammatically, as a longitudinal section, along the running direction of the band, a pickling line comprising a series of treatment tubs 1, 1' separate from one another by transversal walls 11. Each tub contains a bath 10 of treatment liquid and is closed by a lid 12 enabling collection and evacuation of the steams.

The set of tubs is associated with means to control the running of a metallic band 2 represented diagrammatically on FIG. 1, by an unwinder B and a winder B'. Obviously, other well-known devices can be placed on the trajectory of the band 2 running along an average plane P and forming in each of the tubs a loop 21 passing, for instance, over thresholds 13 provided at the upper portion of each transversal wall 11 between two successive tubs, whereas each loop 21 plunges inside the liquid bath 10.

In former units, the bath 10 may be circulated against the running direction of the band, where the level of the bath increases from upstream to downstream, so that a portion of the bath contained, for instance, in the tub 1 may overflow into the previous tub 1' over the threshold 13 or via an orifice 14 provided in the transversal wall 11.

Figure 2:
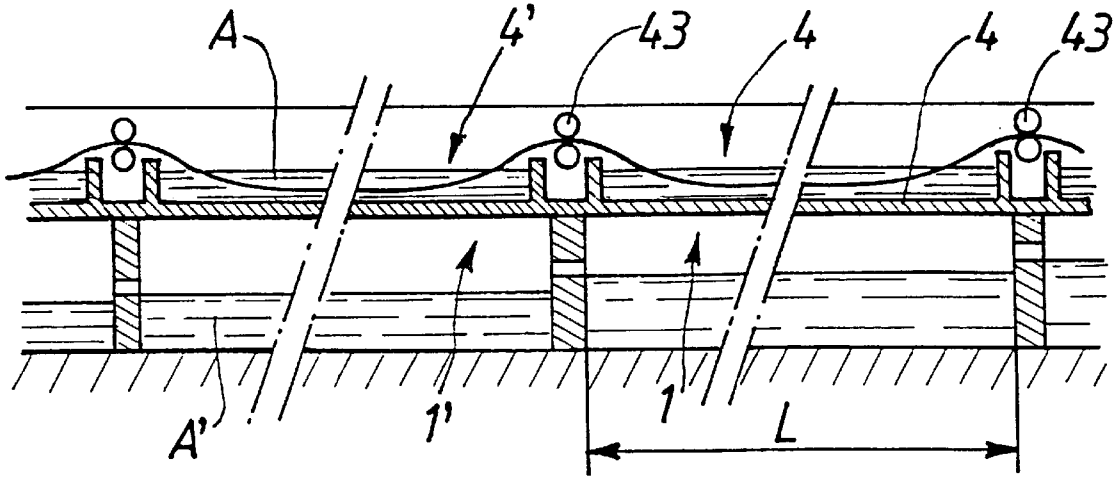
FIG. 2 is a diagrammatic representation of a longitudinal section of the same pickling line after retrofitting.
Figure 3:
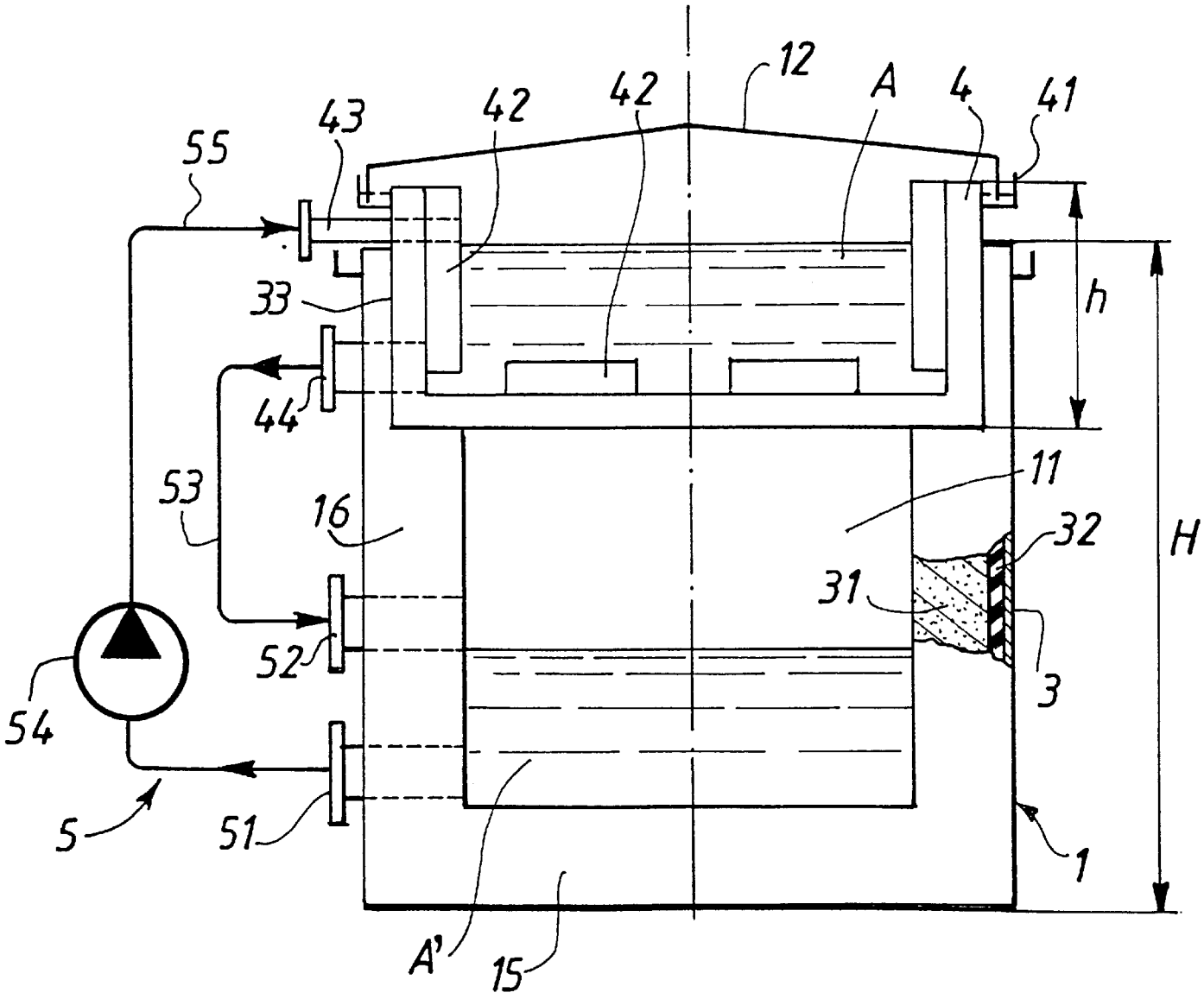
FIG. 3 is a cross section representation of the whole pickling tub, after retrofitting.

On FIG. 2, the same unit has been represented after retrofitting according to the invention, whereas FIG. 3 is a transversal section of a tub.

The extant tubs 1, 1' have been retained practically without any modifications, whereas each tub 1 is limited, as previously, by a bottom 15, two side walls 16 and, at its ends, by two side walls 11 which ensure separation from the adjacent tubs.

The bottom 15 and the side walls 16 are made, as usual, of an external metallic enclosure 3 covered, on its inside, with a coating 31 of refractory and acid-resistant material, with the interposition of a sealing layer 32, for instance of rubber.

According to the invention, each tub 1 is associated with a replacement tub 4 which is located above the extant tub 1. Each replacement tub 4 is made of an oblong vessel with a length more or less equal to the length L of tile extant tub 1 and a height h much smaller than the height H of the latter.

This height h depends on the technique used, whereas the invention enables, indeed, to adapt modern pickling technologies to latter lines. Especially, one can use flat or semi-flat tubs containing a reduced liquid height or connected to liquid injection means in the enclosed space constituted by the tub.

Thus, in the example represented, the replacement tub 4 contains a reduced height of treatment liquid A and is closed by a removable lid 12 which can, besides, be the lid of the extant tub, whereby the replacement tub 4 is fitted with water gaskets 41.

Moreover, the replacement tub can be associated with well-known type appended devices, for example protection devices 42 preventing the band from touching the bottom as well as the lateral sides of the tub 4. Generally, the latter can be made conventionally to resist corrosion, whereas the vessel is made, for instance, of an anti-acid material, of moulded or welded plastic type.

As indicated, the replacement tubs 4, 4' arranged respectively above existing tubs 1, 1' are associated with the extant band running control means so that, as shown on FIG. 2, the band remains more or less at the same level, while circulating inside the replacement tubs 4, 4'.

Preferably, each replacement tub 4 is fitted, respectively at the inlet and outlet, with drying rollers 43 preventing the band from being driven by a certain quantity of solution into the following tub which, normally, contains a solution of higher concentration.

In case when such drying rollers are already associated with the extant tubs 1, 1', it is possible to leave them in place, whereas the running level of the band is not modified.

Each replacement tub 4 can be simply mounted onto an extant tub 1 which serves as a support but, preferably, the replacement tub 4 is embedded in a recess 33 provided at the upper portion of each side wall 16 of the extant tub 1, while removing the refractory coating 31 at least over a portion of its thickness, on order to retain the metallic enclosure 3 and the sealing layer 32. Thus, the height of the existing tub and of the replacement tub is not modified significantly and, especially, the metallic band 2 passing through the replacement tubs remains, more or less, at the previous level.

According to another particularly advantageous characteristic of the invention, the existing tub 1 whose lower position forms an enclosure provided beneath the replacement tub 4 constitutes a recirculation vessel for a portion A' of the treatment liquid A contained in the replacement tub 4.

To this end, each replacement tub 4 can be fitted in advance with inlet 43 and outlet 44 tubes for the treatment liquid which can be connected by a recirculation system 5, respectively to an outlet tube 51 and to an inlet tube 52 provided on the side wall 16 of the extant tub 1, beneath the tub 4. For instance, the outlet tubes 44 provided at the lower section of the replacement tub 4 can be connected by a conduit 53 to a tube 52 provided in the wall 16, for example at halfway up the latter, and enabling to inject into the extant tub 1 a portion of the liquid contained in the replacement tub 4, whereas circulation can take place simply by gravity.

Conversely, an outlet tube 51 provided at the level of the bottom 15 of the extant tub 1 enables sampling a portion of the liquid A' contained in the latter to bring it back into the replacement tub 4 using a pump 54 and a conduit 55 connected to the inlet tube 43.

Thanks to this especially advantageous configuration, it is not necessary to adjoin to each treatment tub a recirculation cistern as in the usual technique.

In case when the extant unit already comprises one or several recirculation cisterns connected to inlet and outlet tubes provided on the walls of each extant tub, these cisterns can be deleted advantageously. The unit is thus simplified and room is made available at the level of the floor. Moreover, the extant tubes 51, 52 can thus be retained and are connected to the tubes 43, 44 of the replacement tub.

It should also be noted that the height difference between the outlet 51 and inlet 43 tubes is reduced with respect to the case when an external cistern is used. The power of the pulp 54 can thus be restrained.

Obviously, each extant tub 1 serving thus as a recirculation vessel can be associated with regeneration means of a well-known type.

It will also be noted that the replacement tub 4 constitutes a lid placed above the extant tub 1 to block tile outlet of acid steams.

Since the recirculation bath A' extends only over a portion of the height of the free space located beneath the replacement tub 4, the recess 33 provided in the side wall 16 is not in contact with the liquid and the refractory coating can thus be deleted, at least partially to enable the replacement tub 4 to be nested.

Obviously, the invention is not limited to the details of the embodiment which has just been previously described, but it also covers the variations which do not deviate from the protection framework defined by the claims.

Especially, the invention can be suited to every well-known technique using flat or semi-flat pickling tubs. For instance, each replacement tub 4 could be made of an enclosed caisson connected to liquid injection means associated with a supply conduit 55, whereas the liquid injected onto the band is collected and returned to the lower tub 1 by a manifold connected to an outlet conduit 53.

Besides, in the embodiment represented on FIG. 2, each extant tub is associated with a replacement tub 4 extending more or less over the same length L, but we could also use shorter tubs provided one after the other above the same extant tub. Conversely, an existing deep tub could serve as a support and as a recirculation tub for a longer replacement tub.

The reference signs inserted after the technical data mentioned in the claim is solely aim at facilitating the understanding of the latter and do not limit their extent in any way.

I claim:

1. A retro-fitting process for an extant treatment unit of a band product, said extant treatment unit comprising at least one extant treatment tub for holding a treatment liquid for the band product and means for controlling the running of the band product inside the extant treatment tub in a longitudinal direction of the product, the extant treatment tub being an oblong vessel having a first height, two side walls substantially parallel to the longitudinal direction of running of the product, and two end walls, said process comprising:

providing at least one replacement tub, said replacement tub being an oblong enclosure with a second height lower than the first height of the extant treatment tub, placing the replacement tub above the extant treatment tub, connecting the replacement tub to the means for controlling running of the band product, and providing and connecting means for injecting the treatment liquid into the replacement tub, whereby passing the band product inside the replacement tub in contact with the treatment liquid injected into the replacement tub is enabled.

2. A retrofitting process according to claim 1, further comprising connecting and using a portion of the extant treatment tub positioned beneath the replacement tub as a recirculation vessel for at least a portion of the treatment liquid injected into the replacement tub.

3. A process according to claims 1, or 2, further comprising resting and supporting the replacement tub on an upper section of the extant treatment tub.

4. A process according to claim 3, further comprising providing a recess on at least a portion of the thickness of the side walls of the extant treatment tub, and engaging the replacement tub at least partially, in the recess.

5. A process according to claim 1, further comprising arranging a section of the extant treatment tub positioned beneath the replacement tub as a recycling vessel of the treatment liquid and connecting a system to the replacement tub for recirculating at least a portion of tile treatment liquid from one of the tubs to the other.

6. A process according to claim 5, further comprising fitting the replacement tub with inlet and outlet tubes for the treatment liquid, providing outlet and inlet tubes on the extant treatment tub, beneath the replacement tub and connecting the inlet and outlet tubes of the replacement tub to the outlet and inlet tubes of the extant treatment tub via said system.

* * * * *